US005308062A

United States Patent [19]

Hogan

[11] Patent Number: 5,308,062

[45] Date of Patent: May 3, 1994

[54] GOLF CLUB SHAFT AND HEAD ASSEMBLY

[75] Inventor: Gerald F. Hogan, New South Wales, Australia

[73] Assignee: Fundamental Golf Company Pty. Ltd., North Sydney, Australia

[21] Appl. No.: 907,685

[22] Filed: Jul. 2, 1992

[51] Int. Cl.[5] ..... A63B 53/04; A63B 53/10

[52] U.S. Cl. ..... 273/80 A; 273/80 B; 273/169; 273/167 H; 273/DIG. 23

[58] Field of Search ..... 273/80 R, 80 B, DIG. 7, 273/DIG. 23, 167 R, 167 H, 169, 167 F, 77 R, 80.6, 80 A

[56] References Cited

U.S. PATENT DOCUMENTS

| | | | |
|---|---|---|---|
| 2,457,177 | 12/1948 | Reach . | |
| 3,519,270 | 7/1970 | Baymiller . | |
| 3,764,137 | 10/1973 | Petro . | |
| 4,000,896 | 1/1977 | Lauraitis | 273/DIG. 23 |
| 4,165,874 | 8/1979 | Lezatte et al. | 273/80 B X |
| 4,169,595 | 10/1979 | Kaugars | 273/80 R |
| 4,203,598 | 5/1980 | Stuff et al. | 273/80 A X |
| 4,288,075 | 9/1981 | Kaugars et al. | 273/80 B |
| 4,319,750 | 3/1982 | Roy . | |
| 4,330,126 | 5/1982 | Rumble | 273/80 R |
| 4,455,022 | 6/1984 | Wright . | |
| 4,563,007 | 1/1986 | Bayliss et al. | 273/77 A |
| 4,591,155 | 5/1986 | Adachi | 273/DIG. 7 |
| 4,955,610 | 9/1990 | Creighton et al. | 273/80 A X |
| 4,982,963 | 1/1991 | Fazio et al. . | |
| 5,004,236 | 4/1991 | Kameshima . | |
| 5,026,056 | 6/1991 | McNally et al. | 273/77 A |

FOREIGN PATENT DOCUMENTS

| | | | |
|---|---|---|---|
| PCTAU8200-182 | 11/1982 | PCT Int'l Appl. . | |
| 465414 | 5/1937 | United Kingdom | 273/80 B |
| 477647 | 1/1938 | United Kingdom | 273/80 R |
| 2181657 | 4/1987 | United Kingdom | 273/77 A |

*Primary Examiner*—Vincent Millin
*Assistant Examiner*—Sebastiano Passaniti
*Attorney, Agent, or Firm*—Brown, Martin, Haller & McClain

[57] ABSTRACT

A golf club has a club head and an elongated tubular shaft secured at its tip end to the head. The shaft has a relatively short, flexible zone spanning the center of the shaft between the butt and tip ends which is more flexible than the remainder of the shaft, forming a tow lever flail.

26 Claims, 2 Drawing Sheets

GOLF CLUB SHAFT AND HEAD ASSEMBLY

BACKGROUND OF THE INVENTION

The present invention relates generally to golf clubs and is particularly concerned with improved golf club shafts to provide increased control and ball flight distance.

Golf club shafts are generally elongate tubular members having a butt end for gripping by the player and a tip end to which a club head is secured. Various types of golf clubs are provided for different playing conditions, including woods and irons. Golf club woods, which may be of wood or metal, have a characteristic rounded head shape with a flat striking face. Iron heads are typically of solid molded metal having a wedge like shape and an angled ball striking face. An integral tubular hosel projects from the heel end of the face for securing the head to a shaft.

Various attempts have been made in the past to improve the ball striking characteristics of golf clubs, by redesign of the shaft or the head portion, or both. The swinging of a standard golf club will produce curvature of the shaft. During the golf swing, the principal objective is to exercise as much control as possible in order to make the ball fly as far as possible in the intended direction. When the shaft curves along its entire length, it is relatively difficult to maintain control and to transfer force from the handle to the club head effectively. Thus, attempts have been made in the past to control the flexing of a golf club shaft as the club is swung to impact the ball. In U.S. Pat. No. 2,457,177 of Reach, for example, a golf club is described which has a waist region of reduced diameter between its ends and enlarged diameter regions at both the head and handle or butt ends of the shaft, in order to stiffen the shaft in the vicinity of the club head, so that the head can engage the ball more accurately. The shaft is made up from a series of telescopically interconnected cylindrical sections of increasing and decreasing diameter. The smallest diameter section is closer to the head or tip end of the shaft than the handle or butt end of the shaft, and provides the point of greatest flexibility of the shaft.

U.S. Pat. No. 4,319,750 of Roy describes a golf shaft having a controlled flex zone at a predetermined location along its length. The shaft is fabricated from layers of different types of fiber materials each having a different modulus of elasticity. The materials are laminated so as to produce a flex point at the interface between the two materials. The butt portion of the shaft extending from the butt end is made more flexible than the remainder of the shaft extending to the tip or club end. The hinge point between the butt and tip portions of the shaft is closer to the butt end, and the shaft is relatively stiff between the hinge point and tip end of the shaft, and curves or flexes the most between the hinge point and butt of the shaft.

SUMMARY OF THE INVENTION

It is an object of this invention to provide a new and improved golf club.

According to one aspect of the present invention, a golf club is provided which comprises a club head and an elongated tubular shaft having a tip end secured to the club head and an opposite, butt end for gripping by a player when swinging the club. The shaft has a central, flexible portion which spans the central point in the length of the shaft, a butt portion extending from the central portion to the butt end of the shaft, and a tip portion extending from the central portion to the tip end of the shaft. The central portion is of greater flexibility than both the butt and tip portions of the shaft.

The length of the central flexible portion is less than that of the tip and butt portions, and is preferably no more than around ¼ of the length of the shaft. In the preferred embodiment of the invention, the shaft is of varying diameter, having a butt end of constant diameter, an intermediate portion of tapering diameter which includes the central flexible portion but is of greater length than the central portion, and a tip end of constant diameter, the diameter of the butt end being greater than that of the tip end. Preferably, the wall thickness is at a maximum at the tip end of the shaft, and the wall thickness is reduced along the remainder of the shaft. This produces more weight at the tip end of the shaft to provide greater momentum on impact with the ball.

In a preferred embodiment of the invention, the shaft is of composite fiber construction, made up of multiple layers of fibers wound on a mandrel, with the fibers being positioned so as to provide the desired flexibility in the central region of the shaft. The fibers are laid 80% longitudinally and 20% rotationally, or at an angle to the shaft axis, in both the butt and tip portions of the shaft, and are laid 20% longitudinally and 80% rotationally in the central region, in order to provide the desired relative flexibility in the central region and stiffness in the two end portions. Preferably, more fiber layers are provided in the tip end to provide increased weight in this region. The butt end is of larger diameter and will therefore also be of increased weight relative to the intermediate region of the shaft. Preferably, the shaft is weighted so as to move the center of gravity closer to the butt end of the shaft than in traditional clubs. Preferably, the center of gravity is located at a point around 1/5 to ⅓ of the length of the shaft from the tip end of the shaft.

The resultant shaft is effectively a two lever flail with the central flexible portion providing a free hinge between the primary lever, or butt portion, and the secondary lever, or tip portion of the shaft. This allows a greater degree of control of the swing and thus potentially improved performance.

According to another aspect of the invention, the club head secured to the tip end of the shaft comprises a solid, generally wedge-shaped head having a front face, a rear face, an upper face, a lower face, a heel and a toe, and a hosel projecting upwardly from the heel for securing to the tip end of the shaft, the front face of the head being angled rearwardly from the lower face to the upper face and the head having a leading edge at the junction between the front face and lower face, and the leading edge is co-planar with the leading portions of the hosel and shaft. This enables the visual appearance of the club head to the golfer at the point of impact to be square.

Preferably, the front face of the head has a plurality of parallel grooves cut at spaced intervals across its surface extending perpendicular to an imaginary line extending between the top and bottom of the toe end of the head. The upper face of the head is inclined from the front of the club head towards the rear.

As compared to traditional iron heads, the head is preferably lighter and the center of mass of the club head is moved more towards the hosel and towards the upper half of the head. Preferably, a recess is provided in the center of the rear face of the head for selectively receiving additional weight to vary the weight of the club according to the needs of individual players.

This shaft construction and head design provides increased accuracy and performance in golfing, achieving greater efficiency in transmitting force to the ball and enabling improved accuracy.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
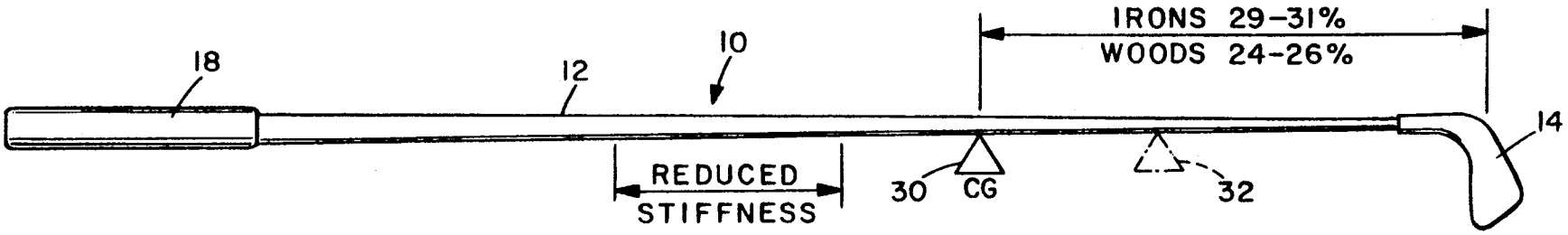
FIG. 1 illustrates the configuration of a complete golf club according to a preferred embodiment of the invention, with the balance point indicated.

The drawings illustrate a golf club 10 having an elongate shaft 12 and a head 14 secured to the tip or lower end 16 of the shaft 12, and a tubular grip or sleeve 18 secured to the butt or handle end of the shaft. In the illustrated embodiment, the head 14 is of the iron type. However, a shaft of the same design as shaft 12 may alternatively be secured to club heads of the metal wood type.

Figure 2:
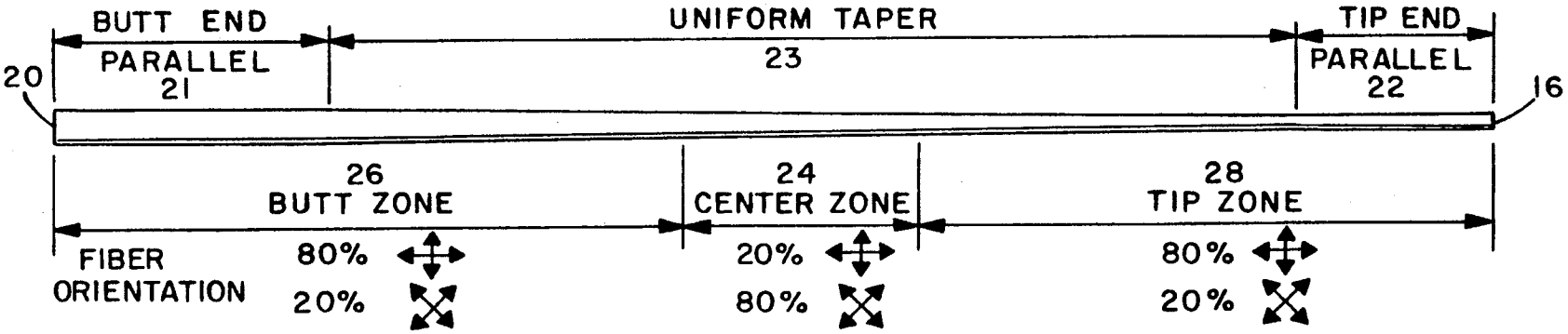
FIG. 2 illustrates the structural zones of the club shaft.

The golf club shaft is illustrated in more detail in FIG. 2 and comprises a hollow tubular shaft of composite fiber construction. The shaft is of a uniform, maximum outer diameter along butt end region 21 and of a uniform, minimum outer diameter along tip end region 22. The remainder 23 of the shaft is of uniformly tapering diameter between the butt and tip end regions of the shaft.

The shaft has a central zone or portion 24 which spans the central point in the length of the shaft and which is of greater flexibility than the remainder of the shaft. Preferably, zone 24 is centered approximately one inch above the center of the shaft. The butt or top zone 26 extending from the central zone to the butt end of the shaft, and the tip or bottom zone 28 extending from the central zone to the tip end of the shaft, are both stronger and stiffer than the flexible central zone 24.

In the preferred embodiment of the invention, the shaft is made by cutting and layering fibers onto a stainless steel mandrel of appropriate shape matching the desired shaft shape, and then baking the assembly in an oven so that the fibers blend into a homogeneous, composite mass. Any fibers of suitable strength may be used, such as standard high strength graphite fibers or the like. The fibers are impregnated with heat sensitive bonding agents.

The direction of winding the fibers on the mandrel and the number of fiber layers are controlled in order to provide the desired flexibility at the central zone 24 and added strength and weight at the tip and butt ends of the shaft. In both the butt zone 26 and tip zone 28 of the shaft, 80% of the fibers are wound at a 0° angle, i.e. oriented longitudinally along the shaft, and 20% are wound cross-wise at an angle of 45° to the shaft axis. In the central zone, 20% of the fibers are at 0° and 80% are at 45°, providing much greater flexibility in this zone than in other regions of the shaft. Additionally, a greater number of layers is provided in the tip or bottom zone of the shaft, for added weight and strength.

In one specific example, three plies of graphite were first wound at 0° along the entire length of the shaft. Four plies were then wound at 0° at the tip end portion 22 only of the shaft. Subsequently, two plies were wound at 0° along the butt zone 26 of the shaft. In the next stage, three plies were wound at 0° around the butt zone. In the central zone only, three plies were wound at +45° and three plies were wound at −45°, while in the tip zone 28 four plies were wound at 0°. Subsequently, three plies were wound at +45° along the entire length of the shaft, followed by three plies at −45° along the length of the shaft. Two plies were then wound at 0° along the tip zone only, and finally two plies were wound at 0° along the length of the shaft with an extra ply at the butt zone. Thus, a total of 17 plies or layers were provided in the butt zone of the shaft, 18 plies in the central zone, and 21 plies in the tip zone of the shaft, although different numbers of layers may be .provided in alternative embodiments. This provides a torque factor of around 2.8% in the central zone and a torque factor of less than 0.5% in the top and bottom zones 26 and 28.

In a preferred embodiment of the invention, the shaft had an overall length of 51 inches, with the length of the central zone being 10 inches and the lengths of the butt and tip zones being 19.5 inches and 21.5 inches, respectively. The central zone was centered one inch above the center of the shaft. The outer diameter of the shaft ranged from 15 mm at the butt end to 9.4 mm at the tip end, while the wall thickness of the shaft ranged from 2.38 mm at the butt end to 2.52 at the central zone and a maximum of 2.94 mm at the tip end of the shaft.

With this arrangement, the shaft is provided with a centrally located flex point at central zone 24 and with stiffer and heavier regions at the butt and tip ends of the shaft. As illustrated in FIG. 1, the heavier butt end of the shaft tends to move the center of gravity 30 of the shaft away from the tip end of the shaft as compared to the center of gravity 32 of a conventional shaft. Preferably, the center of gravity is located at a point 29–31% of the way along the length of the shaft from the tip end for an iron, and 24–26% of the length of the shaft for a wood. The shaft itself is both heavier and longer than conventional shafts. A conventional graphite golf club shaft has a weight of around 70 to 80 grams, whereas this shaft construction will have a weight of 115 to 132 grams, since the shaft itself is 1.5 to 3 inches longer than conventional golf club shafts.

Figure 3:
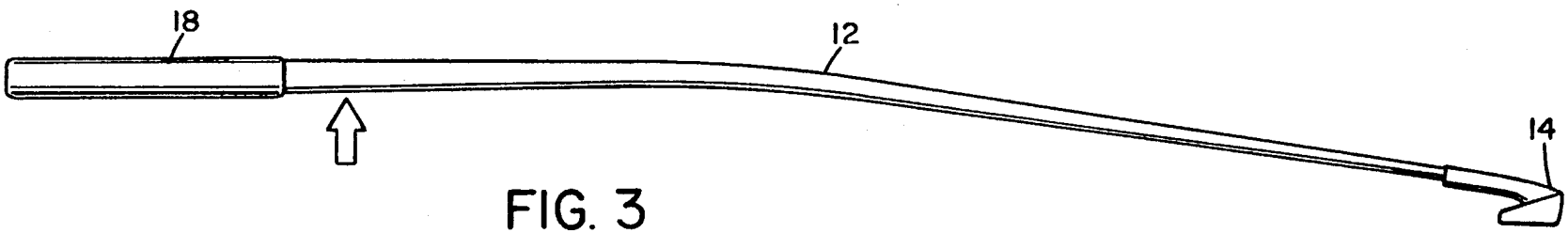
FIG. 3 is a side elevation view of the club showing the flexing action under load.

FIG. 3 illustrates the flexing of the shaft 12 as the club is swung to hit a ball. Any golf club shaft will bend to a certain extent as it is swung, with the amount of bending depending on the flexibility of the shaft material. A conventional shaft generally bends along its entire length, forming a multi-lever flail. However, by designing the shaft to have a relatively short, central zone which is more flexible, the shaft can be controlled to hinge or flex about one region only, dividing the shaft into a primary lever along the butt portion of the shaft and a secondary lever along the tip portion of the shaft.

A two lever flail is much easier to control than a multi-lever flail.

The positioning of the central flex point along with the weight characteristics of the shaft have been found to produce much improved results in hitting a ball. In a golf swing, a player is trying to swing a golf club through an arc of more than 18 feet in a very short time of the order of 2/10 of a second. During this movement, the shaft is flexing and the club head is rotating through up to 120 degrees, and must be returned square to the line of flight to a tolerance of less than 1.5% if the ball is to be kept in play on a 50 yard wide fairway through a driving distance of 250 yards. Ideally, the player should deliver the club to strike the ball with the true center of percussion of the club face. At the same time, the player must fight the forces of centrifugal pull tending to drag the player's arms upwards and outward and away from the intended line of movement.

One factor which helps to determine the amount of control the player is able to keep over movement of the club is the feel and balance of the club. By moving the center of gravity closer to the butt or handle end of the shaft, the player's feel is enhanced and the player is better able to control the swing. Also, the player's balance is improved. By making the shaft longer, the player is able to stand in a more upright position, further improving balance and control.

Another factor in the effective carry-through of the swing to impact the ball is the efficient transmission of energy to the ball. The three major factors over which the player has control and which most influence the flight of the ball are the speed at which the club head is travelling at the moment the ball starts to leave it, the coefficient of restitution of the ball itself, and the type and degree of spin imparted to the ball. On impact, the club will tend to decelerate. By making the tip end of the club stronger and heavier, this tendency is resisted.

When a golf club is swung through an arc, the speed at the tip will clearly be greater than at the handle end since it moves through a greater arc in the same time. By providing a central flex point, the tip moves even faster by pivoting forwards at the flex point in a whip-lash type of movement, as illustrated in FIG. 3. Since the head of the club is moving faster, the speed will tend to be higher at impact. However, on impact with the ball, the head tends to decelerate while the ball reforms before flying away from the head. Thus, the club is designed to resist this deceleration to ensure more efficient transfer of momentum to the ball.

The design of the shaft as a two lever flail therefore allows more effective transmission of energy to the ball. It is much easier to time and control a two lever flail than a conventional golf club shaft which acts as a multiple lever flail. If the butt zone is considered the primary lever and the tip zone is considered the secondary lever, it is clear that the speed of the secondary lever at its tip will be governed by the speed of the primary lever and the length of the secondary lever. The longer the secondary lever, the greater the speed and thus the greater the momentum imparted to the ball. However, it is also important that the golfer be able to maintain control, and this is done by providing increased weight in the butt end of the shaft, giving the muscles a greater load to move. This also generates more energy to be transmitted to the ball.

As mentioned above, a club head will decelerate on collision with the ball, and this deceleration is around 18 to 20% for a conventional golf club. The critical issue in determining the length of flight is not the speed with which the head strikes the ball, but the speed with which the ball leaves the head. Thus, the amount of deceleration is critical. The shaft described above has been found to impart greater momentum to the ball at impact, so that the head slows down less on impact, decelerating around 10 to 12% only, so that about 10% more energy is imparted to the ball. As the ball reforms prior to leaving the club, the heavier shaft provides greater resistance against deceleration. This propels the ball forwards faster so that it leaves the club face at a greater speed and with more backspin. The end result is a longer flight distance.

The weight characteristics of the shaft and the location and design of the central flex zone as described above have been found to provide improved performance both in ball control and flight distance. This same basic shaft may be used both for woods and irons, eliminating the need to carry various different shafts in an inventory.

Any type of wood or iron head may be secured to the tip end of the shaft for improved performance. However, FIG. 3 illustrates a preferred form of iron-type head 14 attached to the shaft 12. This head is modified from conventional iron heads to achieve improved performance when attached to shaft 12. Head 14 is illustrated in more detail in FIGS. 4–7. The principal function of head 14 is to transmit the energy stored through the lever chain during the swing to the ball by taking the shaft through the ball without distortion. This requires the head to have the correct weight relationship to the shaft and requires proper design of the weight distribution in the head itself for optimum performance.

There are a number of forces which act on the head during the swing, which tend to -make the swing more difficult to control. The first is a tangential force which tends to urge the head to move in a tangent out of the arc of movement of the shaft. If the shaft is too light or too weak relative to the weight of the head, this tangential force will cause the head to out-accelerate the shaft and cause the shaft to flex forward too early, with resultant loss of control.

Another force acting on the head is a centrifugal force around the axis of the shaft, tending to rotate the club head. This is enhanced if the mass distribution in the head puts too much weight towards the toe, and also results in loss of control.

Also, if too much weight is placed towards the toe, the shaft will tend to bend into the same plane as the club face during the swing, with the forces on the shaft making it difficult, if not impossible, to recover in order to position the club correctly for impact.

Thus, the relative weights of the shaft and club head are critical in order to ensure proper performance. Too much or too little mass in the club head can cause it to rotate around the axis of the shaft during the swing and/or at the point of impact. It is important that the club head be heavy enough to take the shaft through the ball at impact without distortion and at the same time allowing maximum energy to be transmitted to the ball. The wrong positioning of the mass in the club head can also be critical.

The shaft described above in connection with FIGS. 1–3 is longer and therefore heavier than conventional shafts. The head is made lighter than traditional heads. For a shaft which is 3 inches longer than standard and weighs 125 grams, as compared to a standard weight of 70 to 80 grams, a head of 224 to 228 grams is preferably used. For a shorter shaft which is 1½ inches longer than a standard five iron club, the head weight would be up to 240 grams.

Figure 4:
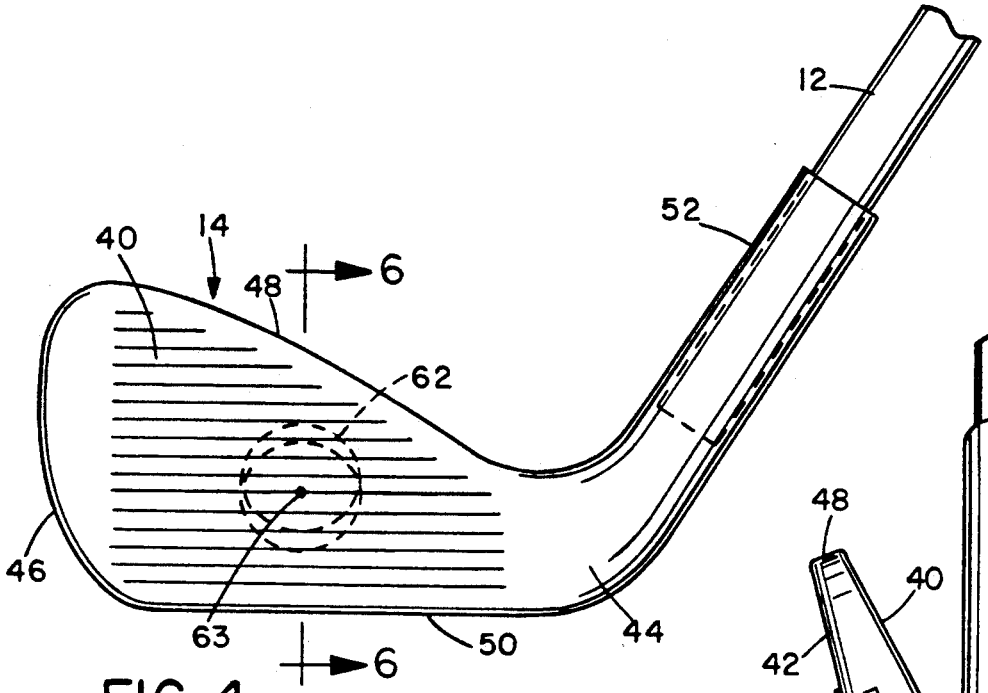
FIG. 4 is a front face view of the club head.
Figure 5:
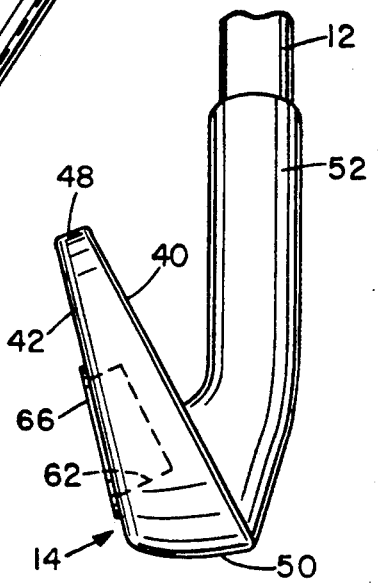
FIG. 5 is a side elevation view of the club head.
Figure 6:
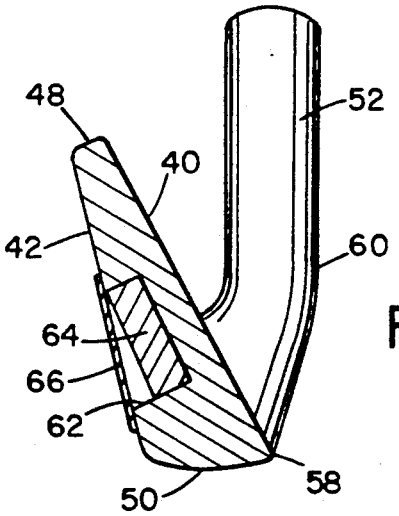
FIG. 6 is a sectional view taken on line 6—6 of FIG. 4.

FIGS. 4–6 illustrate the iron club head 14 according to a preferred embodiment of this invention in more detail. As discussed above, this head will be lighter than conventional iron heads for equivalent clubs. The head is cast of solid metal such as iron or steel and is of generally wedge-like shape, having a front or ball striking face 40, a rear face 42, a heel 44, a toe end 46, an upper face 48 and a lower face 50. A hosel 52 is formed integrally with the head and projects upwardly at an angle from the heel 44 for telescopic attachment to the tip end 16 of the shaft 12 in a conventional manner The ball striking face 40 is inclined rearwardly from its lower to its upper end at a predetermined angle of around 28 degrees, although this may be varied for different types of clubs. The rear face 42 is also inclined rearwardly at a smaller angle. The upper face 48 is inclined downwardly from the toe end of the head to the junction 54 between the heel and the hosel 52. The upper face is inclined downwardly from its junction with the front face to the junction with the rear face, as illustrated in FIGS. 5 and 6. Thus the top of the club head appears to fold back and under from the front of the club head towards the rear. The junctions between the top and toe end of the head, and the lower face and toe end, are smoothly radiused as illustrated in FIG. 4.

Figure 7:
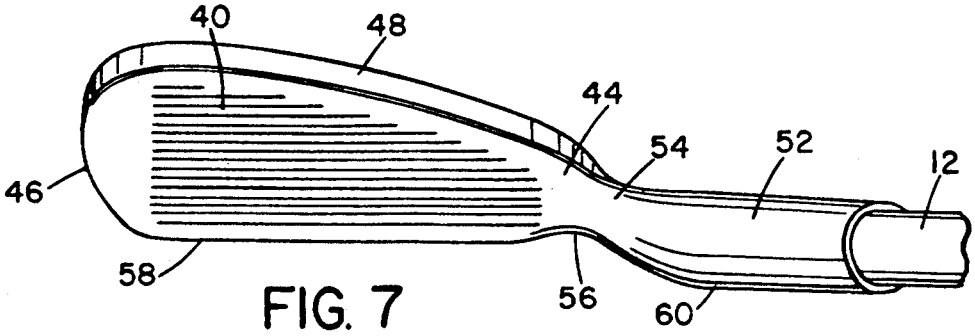
FIG. 7 is a view of the head looking down the length of the shaft.

The striking face 40 is undercut or made thinner at its junction with the hosel, as illustrated at 56 in FIG. 7. This ensures that when the club face is viewed by the player on addressing the ball, the hosel does not obstruct the player's view of the full club face. Additionally, the hosel leading edge 58 is in the same vertical plane as the leading edge 60 of the club head at the bottom of the striking face 40, as best illustrated in FIGS. 5, 6 and 7. Thus, the leading edge of the shaft 12 when secured to the hosel will also lie in the same vertical plane as the leading edge of the club head.

A plurality of parallel grooves 62 are cut into the striking or front face 40 of the head, and these extend at right angle to an imaginary line drawn between the top and bottom of the toe end of the club head, as best illustrated in FIG. 4. A recess 62 is cut in the rear face of the club head. This recess is centered on the center of gravity 63 of the club face, and is designed to selectively receive added weights 64 to control the weight of the head to meet the needs of individual players requesting a heavier head. A range of different weights will be provided and the selected weight is secured in place by cover plate 66. The recess is of slightly elliptical shape and is oriented with its major axis parallel with the inclined upper face of the club head.

The club head shape and positioning relative to the shaft is designed so that the visual appearance of the club head to the golfer at the point of address will be square and the club head is not obstructed in any way as the golfer views it. The appearance of the club head sitting square allows the player to address the ball more accurately and more easily impact the ball at the center of gravity of the club head, with resultant improved control and accuracy.

The distribution of mass through the club head is structured so that the club head will balance at a point 63 in the center of the club face. The mass distribution in club head 14 is different from conventional designs, since more mass is moved towards the hosel and towards the upper half of the club face than in traditional designs. This is achieved by appropriate dimensioning of the club head along its length and height. In one specific example, the thickness of the head at its bottom face was 18 mm while the thickness at the upper face was 5 mm. The length of the head from its toe to its heel was around 73 mm, and the center of gravity was at a height of 16.5 mm from the lower face of the club. The full radius of recess 62 was 24 mm.

The distribution of mass throughout the club head is structured so that the club head on its own will balance at the center of the club face, in other words so that the center of gravity coincides with the geometrical center of the club face, as indicated at 63 in FIG. 4. Conventional iron heads provide too much mass towards the toe and bottom of the club head. This design, in contrast, resists the tendency of the club head to rotate around the shaft during the swing and on impact, and allows more efficient transfer of momentum at the point of impact.

The golf club head and shaft described above provide proper balance in the shaft, improved feel, and an improved relationship between the weight of the head and the shaft along with the ability to transfer momentum more effectively from the club to the ball while maintaining better control both during the swing and on impact with the ball.

Although a preferred embodiment of the invention has been described above by way of example only, it will be understood by those skilled in the field that modifications may be made to the disclosed embodiment without departing from the scope of the invention, which is defined by the appended claims.

I claim:

1. A golf club, comprising:

a club head;

an elongated tubular shaft having a tip end secured to the club head and an opposite, butt end for gripping by a player when swinging the club; and the shaft having a central, flexible zone which spans the central portion in the length of the shaft, a butt zone extending from the central zone to the butt end of the shaft, and a tip zone extending from the central zone to the tip end of the shaft, the central zone being of grater flexibility than both the butt and tip zones, and having a length shorter than the length of each of the butt and tip zones to provide a two-lever flail which hinges about the central zone of the shaft only.

2. The club as claimed in claim 1, wherein the head is of wedge-cross-section and has a rearwardly inclined front face, and the center of gravity of the head is located at the center of the front face.

3. The club as claimed in claim 1, wherein the center of gravity of the shaft is located at a point spaced from the tip end of the shaft by a distance of between 1/5 to ⅓ of the length of the shaft.

4. The club as claimed in claim 1, wherein the shaft length is between 51 and 55 inches.

5. The club as claimed in claim 1, wherein the central zone is centered at a point one inch above the central point in the length of the shaft.

6. The club as claimed in claim 1, wherein the length of the central zone is 10 inches.

7. The club as claimed in claim 1, wherein the shaft wall thickness is greater at the tip end of the shaft than in the remainder of the shaft.

8. The club as claimed in claim 1, wherein the length of the central zone is about half that of each of the butt and tip zones.

9. The club as claimed in claim 8, wherein the butt and tip zones are of approximately equal length.

10. The club as claimed in claim 1, wherein the shaft is of varying outer diameter, having a first, constant outer diameter along a predetermined portion of the shaft extending from the butt end, a second, continuously and uniformly tapering diameter portion from the butt zone towards the tip end of the shaft, ad a third, constant outer diameter from the tapering diameter portion to the tip end of the shaft, the first outer diameter being greater than the third outer diameter, the outer surface of the shaft in the tapering diameter portion tapering uniformly to provide a smooth tapering surface.

11. The club as claimed in claim 10, wherein the tapering diameter portion spans said central flexible zone and is longer than said flexible zone.

12. The club as claimed in claim 1, wherein the weight of the shaft is in the range from 118 to 132 grams.

13. The club as claimed in claim 12, wherein the weight of the head is in the range from 224 to 240 grams.

14. A golf club, comprising:

a club head;

an elongated tubular shaft having a tip end secured to the club head and an opposite, butt end for gripping by a player when swinging the club;

the shaft having a central, flexible zone which spans the central point in the length of the shaft, a butt zone extending from the central zone to the butted of the shaft, and a tip zone extending from the central zone to the tip end of the shaft, the central zone being of greater flexibility than both the butt and tip zones and comprising means for producing a two-lever flail which hinges about the central zone of the shaft only; and the shaft comprising a plurality of layers of wound fibers, the majority of the fibers in the butt and tip zones being wound in a 0° direction parallel to the longitudinal axis of the shaft and the majority of the fibers int he central zone being owned at an angle to the axis of the shaft.

15. The club as claimed in claim 14, wherein the majority of the fibers int he central zone are wound at angles of ±45° to the shaft axis.

16. The club as claimed in claim 15, wherein the fibers in the tip and butt zones are wound with 80% at 0° and 20% at 45°, and the fibers in the central zone are wound with 20% at 0° and 80% at 45°.

17. The club as claimed in claim 14, wherein there are more layers of fibers in the tip zone of the shaft than in the remainder of the shaft.

18. A golf club, comprising:

an elongate tubular shaft having a first, tip end, a second, butt end, and a central, flexible zone between said ends which is more flexible than the remainder of the shaft;

a head secured to the tip end of the shaft, the head having a wedge-shaped body with a front, ball striking face, a rear face, a lower face, an upper face, a heel ad a toe, and a hosel tube formed integrally with the body and projecting upwardly from the heel end of the body, the tip end of the shaft being secured to the hosel, the hosel tube having a leading portion facing in a ball striking direction of the club; and the front face being inclined rearwardly from the lower face to the upper face of the body, and the front face having a leading edge at the junction between the front face and lower face of the body, the leading edge lying in the same plane as the leading portion of the hosel; and the front face being indented at the junction between the front face and hosel.

19. The club as claimed in claim 18, wherein the center of gravity of the club head is located at the center of the club face.

20. The club as claimed in claim 18, wherein the body has a recessed area at its rear face for receiving added weight, the recessed area being centered at the center of gravity of the club head.

21. The club as claimed in claim 18, wherein the front face has a plurality of spaced, parallel grooves extending across its area, the grooves being oriented perpendicular to a line extending between the upper and lower face of the head at the toe of the front face.

22. The club as claimed in claim 18, wherein the upper face of the club head is inclined downwardly between the front and rear face of the head.

23. A golf club shaft, comprising:

an elongated tubular shaft having a tip end for securing to a club head and a butt end for gripping by a player; and the shaft having a central flexible zone of a first length spanning the center of the shaft, a butt zone of a second length extending from the flexible zone to the butt end of the shaft, and a tip zone of a third length extending from the central flexible zone to the tip end of the shaft, the central zone being more flexible than the remainder of the shaft, and the first length being less than each of the second and third lengths.

24. The shaft as claimed in claim 23, wherein the torque factor in the butt and tip zones of the shaft is less than 0.5% and the torque factor in the central flexible zone is approximately 2.8%.

25. The shaft as claimed in claim 23, wherein the shaft has a torque which varies along the length of the shaft.

26. The shaft as claimed in claim 25, wherein the shaft torque is int he range of 0–0.5% in the butt and tip zones of the shaft, and is 2.8% in the central zone of the shaft.

* * * * *

UNITED STATES PATENT AND TRADEMARK OFFICE

CERTIFICATE OF CORRECTION

PATENT NO. : 5,308,062

DATED : May 3, 1994

INVENTOR(S) : GERALD F. HOGAN

It is certified that error appears in the above-indentified patent and that said Letters Patent is hereby corrected as shown below:

Column 8, line 41, delete "portion" and insert --point--;

Column 9, line 46, delete "int he" and insert --in the--;

Delete "owned" and insert --wound--;

Column 9, line 49, delete "int he" and insert --in the--;

Column 10, line 8, delete "ad" and insert --and--; and

Column 10, line 57, delete "int he" and insert --in the--.

Signed and Sealed this

Fifteenth Day of November, 1994

*Attest:*

Bruce Lehman

BRUCE LEHMAN

*Attesting Officer*

*Commissioner of Patents and Trademarks*